US006358902B1

(12) United States Patent
Angell et al.

(10) Patent No.: US 6,358,902 B1
(45) Date of Patent: Mar. 19, 2002

(54) DETERGENT TABLET CONTAINING BLEACH ACTIVATOR OF SPECIFIC PARTICLE SIZE

(75) Inventors: Adrian John Waynforth Angell, West Chester; Les Charles Zorb, Loveland, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/674,049

(22) PCT Filed: Apr. 21, 1999

(86) PCT No.: PCT/IB99/00707

§ 371 Date: Oct. 25, 2000

§ 102(e) Date: Oct. 25, 2000

(87) PCT Pub. No.: WO99/55818

PCT Pub. Date: Nov. 4, 1999

Related U.S. Application Data

(60) Provisional application No. 60/083,256, filed on Apr. 27, 1998.

(51) Int. Cl.[7] ..... C11D 3/395; C11D 3/39; C11D 7/54; C11D 17/00

(52) U.S. Cl. ..... 510/313; 510/311; 510/312; 510/315; 510/349; 510/376; 510/377; 510/295; 510/446; 8/111; 8/137

(58) Field of Search ..... 510/311, 312, 510/313, 315, 349, 376, 377, 446, 295; 8/111, 137

(56) References Cited

U.S. PATENT DOCUMENTS

| | | | | | |
|---|---|---|---|---|---|
| 5,002,679 | A | | 3/1991 | Tai | 252/90 |
| 5,318,733 | A | * | 6/1994 | Carduck et al. | 264/15 |
| 5,407,594 | A | * | 4/1995 | Fry et al. | 252/90 |
| 5,900,399 | A | * | 5/1999 | Seiter et al. | 510/446 |
| 5,916,866 | A | * | 6/1999 | Davies et al. | 510/441 |
| 6,087,311 | A | * | 7/2000 | Van Dijk | 510/294 |
| 6,169,062 | B1 | * | 1/2001 | Salager et al. | 510/294 |
| 6,177,398 | B1 | * | 1/2001 | McGregor et al. | 510/446 |
| 6,232,284 | B1 | * | 5/2001 | Van Dijk et al. | 510/446 |
| 6,274,538 | B1 | * | 8/2001 | Addison | 510/224 |
| 6,303,561 | B1 | * | 10/2001 | Painter | 510/446 |

FOREIGN PATENT DOCUMENTS

| | | | |
|---|---|---|---|
| DE | 40 10 53 A1 | 10/1991 | C11D/17/00 |
| EP | 0 343 069 | 11/1989 | D06F/39/02 |
| EP | 0 481 792 A1 | 4/1992 | C11D/17/00 |
| EP | 0 711 828 A2 | 5/1996 | C11D/17/00 |
| EP | 0 737 738 A2 | 10/1996 | C11D/3/39 |
| WO | WO 97/43367 | 11/1997 | C11D/1/62 |

* cited by examiner

*Primary Examiner*—Gregory Delcotto
(74) *Attorney, Agent, or Firm*—Marianne Dressman; Kim William Zerby; Steven W. Miller

(57) ABSTRACT

A detergent tablet which contains a bleach activator is disclosed. The bleach activator is in particulate form and has a particle size in a range of from about 100 microns to about 4000 microns. The bleach activator is present in a range of from about 0.1% to about 15% by weight of the detergent tablet.

17 Claims, No Drawings

DETERGENT TABLET CONTAINING BLEACH ACTIVATOR OF SPECIFIC PARTICLE SIZE

This application claims the benefit of U.S. Provisional Application No. 60/083,256, filed Apr. 27, 1998.

FIELD OF THE INVENTION

The present invention relates generally to a non-particulate detergent product, and particularly to a non-particulate detergent product containing bleach activator particles dispersed within a high density compressed detergent matrix for improved bleach activator activity, stability and performance.

BACKGROUND OF THE INVENTION

Surface bleaching of textiles is a bleaching mechanism that occurs on the textile surface and, thereby, removes stains and/or soils. Typical bleaching compositions contain peroxygen bleaches capable of yielding hydrogen peroxide in aqueous solutions and bleach activators to enhance bleach performance. It has long been known that peroxygen bleaches are effective for stain and/or soil removal from textiles, but that they are also extremely temperature dependent. Such bleaches are essentially only practicable and/or effective in bleaching solutions, i.e., a bleach and water mixture, wherein the solution temperature is above about 60° C. At bleach solution temperatures of about 60° C., peroxygen bleaches are only partially effective and, therefore, in order to obtain a desirable level of bleaching performance extremely high levels of peroxygen bleach must be added to the system. This is economically impracticable for large-scale commercialization of modern detergent products. As the bleach solution temperature is lowered below 60° C., peroxygen bleaches are rendered ineffective, regardless of the level of peroxygen bleach added to the system. The temperature dependence of peroxygen bleaches is significant because such bleaches are commonly used as a detergent adjuvant in textile wash processes that utilize an automatic household washing machine at wash water temperatures below 60° C. Such wash temperatures are utilized because of textile care and energy considerations. As a consequence of such a wash process, there has been much industrial research to develop substances, generally referred to as bleach activators, that render peroxygen bleaches effective at bleach solution temperatures below 60° C.

Numerous substances have been disclosed in the art as effective bleach activators. For example, bleach activators having the general formula

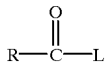

wherein R is an alkyl group and L is a leaving group, have been disclosed in the art. Such bleach activators have typically been incorporated into detergent products as an admixed granule, agglomerate or other type of particle. However, one problem with such bleach activators is maintaining the stability of the activator prior to use by the consumer. The bleach activator granule or agglomerate has a tendency to degrade over time which is exacerbated by exposure to environmental effects such as heat and humidity. As a consequence of this, the granule, agglomerate or other particulate form of the bleach activator must be relatively large in comparison to the other detergent ingredients in a typical granular detergent product. This, in turn, causes another problem associated with detergent product segregation in that the larger bleach activator particles tend to accumulate at or near the top of the detergent box while relatively smaller particle sized detergent ingredients accumulate at or near the bottom of the box. Additionally, particle segregation occurs during the detergent manufacturing process, leading to increased box to box variability for the detergent active ingredients. The net result of such an undesirable product segregation is decreased performance since the user scoops the product from the top to the bottom and each scoop has a disproportionate amount of bleach activator or other detergent ingredient, and similarly, the performance of product from different boxes is affected by variance in the detergent composition.

Thus, it is desirable to have a detergent product containing a bleach activator which has improved stability prior to use, and which does not significantly segregate prior to packaging or while stored in the detergent product box. Additionally, it is desirable to have a detergent composition which also has acceptable physical properties, for example, acceptable flow properties for bulk handling of the composition as part of large-scale detergent manufacturing.

Yet another problem with the aforementioned bleach activators relates to the inability to advertise the sanitization effects of the above-mentioned bleach/bleach activator systems on fabrics. Currently, most government regulation agencies require that sanitization advertising claims for fabric care can only be made if a relatively high level of microbes are consistently removed from the laundered fabrics as a result of using the bleach-containing detergent product. In the past, however, the relatively large granule, agglomerate or other particle form of the bleach activator has inhibited such sanitization advertising claims in that the product segregation effects of such larger particles prevented the consistent removal of high levels of microbes from the laundered fabrics. The bleach/bleach activator delivery during the laundering process varied too widely to satisfy most governmental agency requirements for sanitization advertising claims. It is therefore desirable to have a bleach-containing detergent product which can be used to sanitize fabrics.

Accordingly, there remains a need in the art to have a detergent product containing a bleach activator which has improved stability prior to use. Also, there is a need in the art for a detergent product containing a bleach activator which does not significantly segregate while stored in the detergent product box and has acceptable physical properties. Yet another need in the art remains for such a detergent product which has a more consistent bleach/bleach activator delivery.

Non-particulate detergents are an attractive alternative to granular or particulate forms of detergents from the standpoint of simplifying the dosing of such detergents for automatic laundry or dishwashing machines. Non-particulate detergents are usually supplied in the form of bars, tablets or briquettes and they not only prevent spillage of the detergent composition but also eliminate the need for the consumer to estimate the correct dosage of the detergent composition per wash. Non-particulate detergents minimize the contact by the consumer with the detergent.

The present invention exploits some of the advantages of non-particulate detergents and also solves some of the problems associated with particulate detergent compositions containing bleach and bleach activators.

Accordingly, it is an object of the invention to provide a non-particulate detergent product containing bleach activator particles which have good stability prior to use and acceptable physical properties. It is also an object of the invention to provide a non-particulate detergent product containing bleach activator particles which do not segregate while stored in the detergent product box. Another object of the invention is to provide such a detergent product which can be used to sanitize fabrics. These and other objects, features and attendant advantages of the present invention will become apparent to those skilled in the art from a reading of the following detailed description of the preferred embodiment and the appended claims.

BACKGROUND ART

The following references relate to detergent compositions containing bleach activators and/or antimicrobials: U.S. Pat. No. 4,412,934 to Chung et al (Procter & Gamble); U.S. Pat. No. 5,021,182 to Jentsch (Roman A. Epp); U.S. Pat. No. 5,489,434 to Oakes et al (Ecolab) and U.S. Pat. No. 4,422,950 to Kemper et al (Lever Brothers Company). The following references relate to tableted detergents: GB-A-0 989 683, published on Apr. 22nd 1965, discloses a process for preparing a particulate detergent from surfactants and inorganic salts; spraying on water-soluble silicate; and pressing the detergent particles into a solid form-retaining tablet. Finally a readily water-soluble organic film-forming polymer (for example, polyvinyl alcohol) provides a coating to make the detergent tablet resistant to abrasion an d accidental breakage. European publication a EP-A-0 002 293, published on Jun. 13th 1979, discloses a tablet coating comprising hydrated salt such as acetate, metaborate, orthophosphate, tartrate, and sulphate. Another European publication, EP-A-0 716 144, published on Jun. 12th 1996, also discloses laundry detergent tablets with water-soluble coatings which may be organic polymers including acrylic/maleic co-polymer, polyethylene glycol, PVPVA, and sugar.

SUMMARY OF THE INVENTION

In one aspect of the present invention, a non-particulate detergent product containing a bleach activator having the general formula:

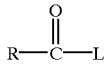

is provided. R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_\alpha$ in the range of from about 6 to about 13. The bleach activator is in particulate form and has a mean particle size in a range of from about 100 microns to about 4000 microns. The bleach activator is present in a range of from about 0.1% to about 15% by weight of the non-particulate detergent product. The bleach activator is dispersed within a matrix formed of the non-particulate detergent product and the bleach activator, and the matrix has a density of at least 1000 g/l.

The small sized bleach activator particles, which can have various forms, such as extrudates or irregularly shaped particles, remain dispersed in the compressed matrix and thus do not undergo product segregation as is often encountered in the case of detergent compositions in particulate form in a detergent box in which they are contained. Further, the bleach activator particles exhibit greater activity because of their smaller size and their consequently larger surface area which more closely mirrors the particle size of other conventional detergent ingredients. Additionally, the bleach activator particles having the above small particle size have acceptable flow properties and allow the detergent composition to deliver sanitization effects to the laundered fabrics more consistently.

In another aspect of the present invention, a method of laundering soiled clothes includes the step of immersing said soiled clothes in an aqueous medium containing an effective amount of a non-particulate detergent product made by a process as set forth above.

In still another aspect of the present invention, a method of laundering fabric materials in a washing machine is provided. The method includes the steps of providing a flexible porous bag adapted for receiving a non-particulate detergent product, providing a non-particulate detergent product made according to the process described above, placing the non-particulate detergent product within the flexible porous bag, and placing the flexible porous bag containing the detergent product in the washing machine with the fabric materials to be washed. The flexible porous bag is adapted for permitting entry of an aqueous washing medium through the bag, thereby dissolving the non-particulate detergent product placed therein, into the aqueous washing medium, and releasing a resultant wash solution from inside of the bag to outside of the bag and into the aqueous wash medium during a wash cycle.

DETAILED DESCRIPTION OF THE PREFERRED EMBODIMENT

In the preferred embodiment, the bleach activator particles are in the form of cylindrically shaped extrudates that are chopped into small particles.

The phrase "cylindrically-shaped extrudates" means an extruded particle having a surface shape generated by a straight line moving parallel to a fixed straight line and intersecting a fixed planar closed curve. An "effective amount" of a detergent composition containing a bleach activator is any amount capable of measurably improving both soil removal from and sanitization of the fabric when it is washed by the consumer. In general, this amount may vary quite widely. As used herein, the terms "disinfecting", "disinfection", "antibacterial", "germ kill", and "sanitization" are intended to mean killing microbes commonly found in and on fabrics requiring laundering. Examples of various microbes include germs, bacteria, viruses, parasites, and fungi/spores. As used herein, "free water" level means the level on a percentage by weight basis of water in the detergent composition which is not bound up or in another detergent ingredient such as zeolite; it is the water level in excess of any water entrained in, adsorbed in, or otherwise bound up in other detergent ingredients.

In the preferred embodiment of one aspect of the invention, a non-particulate detergent product containing a bleach activator having the general formula:

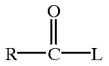

is provided. R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_\alpha$ in the range of from about 6 to about 13. The bleach activator is in particulate form and has a mean particle size in a range of from about 100 microns to about 4000 microns. The bleach activator is present in a range of from about 0.1% to about 15% by weight of the non-particulate detergent product. The bleach activator is dispersed within a matrix formed of the non-particulate detergent product and the bleach activator, and the matrix has a density of at least 1000 g/l.

The detergent product of the invention essentially comprises two components, namely, a peroxygen bleaching compound and a bleach activator in substantially cylindrically-shape extrudate form. Preferably, the peroxygen bleaching compound is capable of yielding hydrogen peroxide in an aqueous solution. The detergent product of the invention is unexpectedly stable with respect to the bleach activator in terms of maintaining or not degrading over extended storage periods prior to use. Preferably, one or more binder materials are included in the bleach activator extrudates including, but not limited to, palmitic acid, a detersive surfactant, polyethylene glycol and other fatty acids and polyacrylates.

While not intending to be bound by theory, it is believed that by selecting a particle size as described herein, the bleach activator exhibits increased activity due to large surface area and because the bleach activator particles are affixed in a compressed matrix, there is absolutely no chance of segregation, resulting in a very consistent release of the bleach activator in the wash solution.

In the preferred embodiment, the bleach activator is in particulate form and has a mean particle size preferably in a range of from about 200 microns to about 3000 microns, m or e preferably in a range of from about 200 microns to about 2000 microns, even more preferably, in a range of from about 200 microns to about 1500 microns, and most preferably, in a range of from about 300 microns to about 1000 microns.

To yield acceptable flow properties for bulk handling of the extrudates being mixed in the particulate detergent composition, prior to compacting, a finely divided inorganic powder may be added as a flow aid to the surface of the extrudates. This flow aid includes, but is not limited to, finely divided aluminosilicates, silicas, crystalline layered silicates, MAP zeolites, citrates, amorphous silicates, sodium carbonate, and mixtures thereof. It is preferable for the level of the flow aid to be from about 0.1% to about 10%, more preferably from about 1% to about 7%, and most preferably from about 1.5% to about 5% by weight of the detergent composition. The most preferable flow aid is aluminosilicate.

The peroxygen bleaching compound is preferably selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof It is preferable for the detergent composition of the invention to contain less than about 3%, more preferably less than about 2.5%, and most preferably less than about 2% by weight of free water. While not wishing to be bound by theory, it is believed that by maintaining this relatively low level of free water in the composition, the propensity of the bleach activator to degrade via hydrolysis prior to use is lowered. Thus, the stability of the bleach activator is enhanced and prolonged even further as a result of a selected free water level as set forth herein.

The selected relatively smaller particle size and cylindrical shape of the bleach activator extrudates affixed within a matrix having a density of at least 1000 g/l results in a more consistent delivery of activator to the aqueous laundering solution. Stated differently, the variation around the target level of bleach activator to be delivered to the wash solution is unexpectedly reduced as result of using a narrow particle size range of the bleach activators and fixing them in a compressed detergent matrix.

Fortuitously, this allows the detergent composition to deliver the bleach activator at a more consistent level to achieve sanitization effects on the laundered fabrics. Most governmental agencies require very little variation around bleach activator or other sanitizing agent target levels in order for sanitization advertising claims to be legally made to the public. Thus, the invention also provides a suitable and convenient method of sanitizing fabrics which may be suitable for public advertising. Preferably, the number of microbes present on said fabrics is reduced by at least about 50%, more preferably reduced by at least about 90%, and most preferably reduced by at least about 99.9%. This sanitizing method is interchangeably used with disinfecting, antibacterial, germ killing, odor-causing germ killing methods in accordance with the invention.

Additionally, the specific bleach activator and peroxygen bleaching composition in the detergent composition are preferably present at specific molar ratios of hydrogen peroxide to bleach activator. Such compositions provide extremely effective and efficient surface bleaching of textiles which thereby remove stains and/or soils from the textiles. Such compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up". The bleach-containing detergent compositions of this invention provide such bleaching over a wide range of bleach solution temperatures. Such bleaching is obtained in bleach solutions wherein the solution temperature is at least about 5° C. Without the bleach activator, such peroxygen bleaches would be ineffective and/or impracticable at temperatures below about 60° C.

Much lower levels of the bleach activators within the invention are required, on a molar basis, to achieve the same level of surface bleaching performance that is obtained with similar bleach activators containing only from about 2 to about 5 carbon atoms in the longest linear alkyl chain extending from and including the carbonyl carbon. Without being bound by theory, it is believed that such efficiency is achieved because the bleach activators within the invention exhibit surface activity. This can be explained as follows. The bleaching mechanism generally, and the surface bleaching mechanism in particular, are not completely understood. However, it is generally believed that the bleach activator undergoes nucleophile attack by a perhydroxide anion, which is generated from the hydrogen peroxide evolved by the peroxygen bleach, to form a percarboxylic acid. This reaction is commonly referred to as perhydrolysis. The percarboxylic acid then forms a reactive dimer with its anion which, in turn, evolves a singlet oxygen which is believed to be the active bleaching component. It is theorized that the singlet oxygen must be evolved at or near the textile surface in order to provide surface bleaching. Otherwise, the singlet oxygen will provide bleaching, but not at the textile surface. Such bleaching is known as solution bleaching, i.e., the bleaching of soils in the bleach solution.

To ensure that the singlet oxygen is more efficiently evolved at the textile surface, it is essential that the longest linear alkyl chain extending from and including the carbonyl carbon of the percarboxylic acid have from about 6 to about 10 carbon atoms. Such percarboxylic acids are surface active and, therefore, tend to be concentrated at the textile surface. Percarboxylic acids containing fewer carbon atoms in such alkyl chain have similar redox potentials, but do not have the ability to concentrate at the textile surface. Therefore, the bleach activators within the invention are extremely efficient because much lower levels, on a molar basis, of such bleach activators are required to get the same level of surface bleaching performance as with similar bleach activators containing fewer carbon atoms in such an alkyl chain, which are not within the invention.

Optimum surface bleaching performance is obtained with bleaching solutions wherein the pH of such solution is between about 8.5 and 10.5 and preferably between 9 and 10. It is preferred that such pH be greater than 9 not only to optimize surface bleaching performance, but also to prevent the bleaching solution from having an undesirable odor. It has been observed that once the pH of the bleaching solution drops below 9, the bleaching solution has an undesirable odor. Such pH can be obtained with substances commonly known as buffering agents, which are optional components of the bleaching compositions herein.

In a highly preferred embodiment of the invention, the substantially cylindrically-shaped extrudate comprises, by weight of the extrudate, from about 60% to about 95% of a bleach activator, from about 0.1% to about 10% of palmitic acid, from about 0.1% to about 10% of a detersive surfactant, from about 0.1% to about 10% of polyethylene glycol, and from about 0.1% to about 10% of fatty acid.

Bleach Activators

The bleach activator for the bleaching systems useful herein preferably has the following structure:

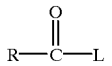

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a pKα in the range of from about 4 to about 13, preferably from about 6 to about 11, most preferably from about 8 to about 11.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attach by the perhydroxide anion.

The L group must be sufficiently reactive for the reaction to occur within the optimum time frame (e.g., a wash cycle). However, if L is too reactive, this activator will be difficult to stabilize. These characteristics are generally paralleled by the pKα of the conjugate acid of the leaving group, although exceptions to this convention are known.

Preferred bleach activators are those of the general formula:

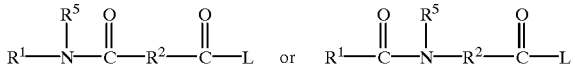

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is selected from the group consisting of:

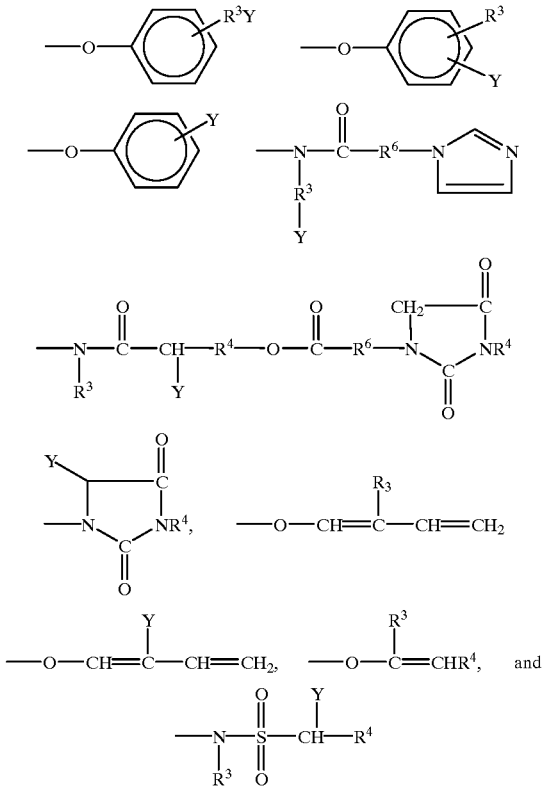

wherein $R^6$ is an alkylene, arylene, or alkarylene group containing from about 1 to about 14 carbon atoms, $R^3$ is an alkyl chain containing from about 1 to about 8 carbon atoms, $R^4$ is H or $R^3$, and Y is H or a solubilizing group. Y is preferably selected from the group consisting of —$SO_3$—M+, —COO—M+, —$SO_4$—M+, (—N+$R'_3$)X— and O←N($R'_3$), wherein R' is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is an anion selected from the group consisting of halide, hydroxide, methylsulfate and acetate anions. More preferably, Y is —$SO_3$—M+ and —COO—M+. It should be noted that bleach activators with a leaving group that does not contain a solubilizing group should be well dispersed in the bleach solution in order to assist in their dissolution. Preferred is:

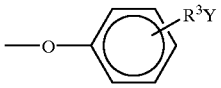

wherein $R^3$ is as defined above and Y is —$SO_3$—M+ or —COO—M+ wherein M is as defined above.

Especially preferred bleach activators are those wherein $R^1$ is a linear alkyl chain containing from about 6 to about 12 carbon atoms, $R^2$ is a linear alkylene chain containing from about 2 to about 6 carbon atoms, $R^5$ is H, and L is selected from the group consisting of:

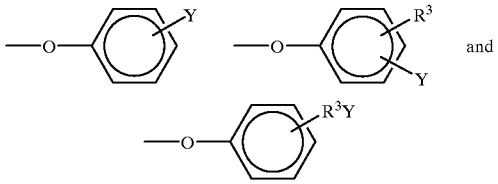

wherein $R^3$ is as defined above, Y is —$SO_3$—M+ or —COO—M+ and M is as defined above.

A preferred bleach activator is:

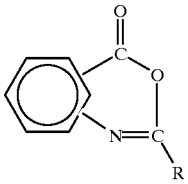

wherein R is H, alkyl, aryl or alkaryl. This is described in U.S. Pat. No. 4,966,723, Hodge et al., incorporated by reference herein.

Preferred bleach activators are:

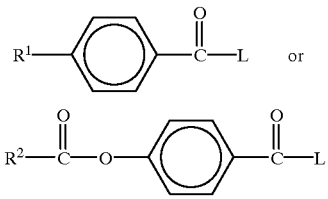

wherein $R^1$ is H or an alkyl group containing from about 1 to about 6 carbon atoms and $R^2$ is an alkyl group containing from about 1 to about 6 carbon atoms and L is as defined above.

Preferred bleach activators are also those of the above general formula wherein L is as defined in the general formula, and $R^1$ is H or an alkyl group containing from about 1 to about 4 carbon atoms. Even more preferred are bleach activators of the above general formula wherein L is as defined in the general formula and $R^1$ is a H.

More preferred bleach activators are those of the above general formula wherein R is a linear alkyl chain containing from about 5 to about 12 and preferably from about 6 to about 8 carbon atoms and L is selected from the group consisting of:

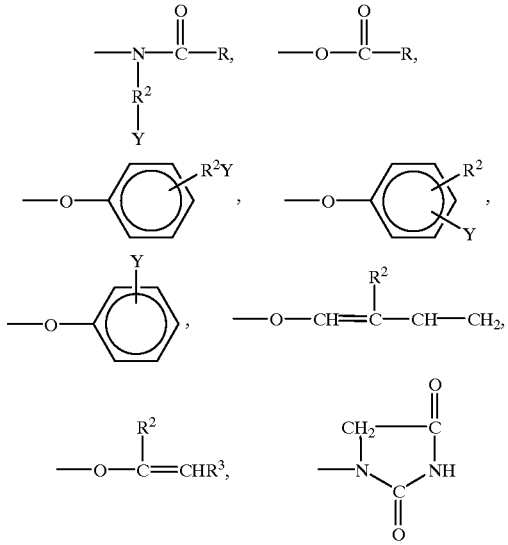

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 6 to about 10 carbon atoms, and L is selected from the group consisting of:

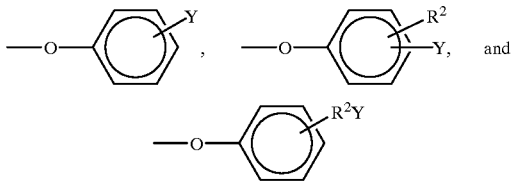

herein $R^2$ is an alkyl chain containing from about 1 to about 8 carbon atoms, and Y is —$SO_3$M+ or —COO—M+ wherein M is an alkali metal, ammonium or substituted ammonium cation.

Especially preferred bleach activators are those of the above general formula wherein R is a linear alkyl chain containing from about 5 to about 12 and preferably from about 6 to about 8 carbon atoms and L is selected from the group consisting of:

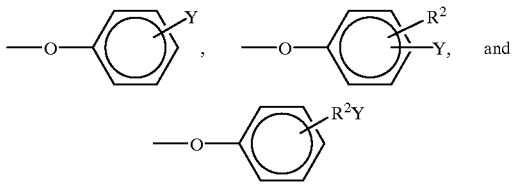

wherein $R^2$ is as defined above and Y is —$SO_3$M+ or —COO—M+ wherein M is as defined above.

The most preferred bleach activators have the formula:

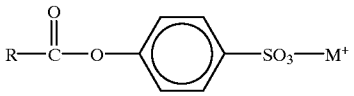

wherein R is a linear alkyl chain containing from about 5 to about 12 and preferably from about 6 to about 8 carbon atoms and M is sodium or potassium.

Preferably, the bleach activator herein is sodium nonanoyloxybenzenesulfonate (NOBS) or sodium benzoyloxybenzenesulfonate (BOBS).

Further particularly preferred for use in the present invention bleaching compositions are the following bleach activators which are particularly safe for use with machines having natural rubber parts. This is believed to be the result of not producing oily diacylperoxide (DAP) species by the perhydrolysis reaction of these amido acid-derived bleach activators, but rather forming insoluble crystalline solid DAP's. These solids are believed to not form a coating film and thus natural rubber parts are not exposed to DAP's for extended periods of time. These preferred bleach activators are members selected from the group consisting of:

a) a bleach activator of the general formula:

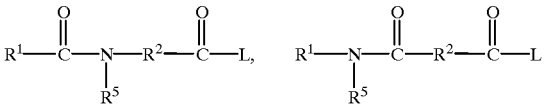

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

b) benzoxazin-type bleach activators of the general formula:

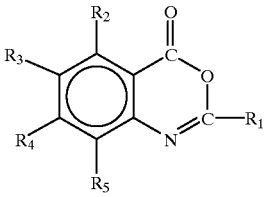

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, $COOR_6$ (wherein $R_6$ is H or an alkyl group) and carbonyl functions;

c) N-acyl caprolactam bleach activators of the formula:

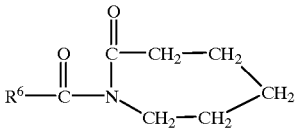

wherein $R^6$ is H or an alkyl, aryl, alkoxyaryl or alkaryl group containing from 1 to 12 carbons; and d) mixtures of a), b) and c).

Preferred bleach activators of type a) are those wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about 10 carbon atoms and $R^2$ contains from about 4 to about 5 carbon atoms.

Preferred bleach activators of type b) are those wherein $R_2$, $R_3$, $R_4$, and $R_5$ are H and $R_1$ is a phenyl group.

The preferred acyl moieties of said N-acyl caprolactam bleach activators of type c) have the formula $R^6$—CO— wherein $R^6$ is H or an alkyl, aryl, alkoxyaryl, or alkaryl group containing from 1 to 12 carbons, preferably from 6 to 12 carbon atoms. In highly preferred embodiments, $R^6$ is a member selected from the group consisting of phenyl, heptyl, octyl, nonyl, 2,4,4-trimethylpentyl, decenyl and mixtures thereof.

Amido Derived Bleach Activators—The bleach activators of type a) employed in the present invention are amide substituted compounds of the general formulas:

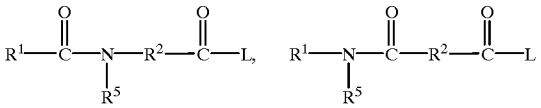

or mixtures thereof, wherein $R^1$, $R^2$ and $R^5$ are as defined above and L can be essentially any suitable leaving group. Preferred bleach activators are those of the above general formula wherein $R^1$, $R^2$ and $R^5$ are as defined for the peroxyacid and L is selected from the group consisting of:

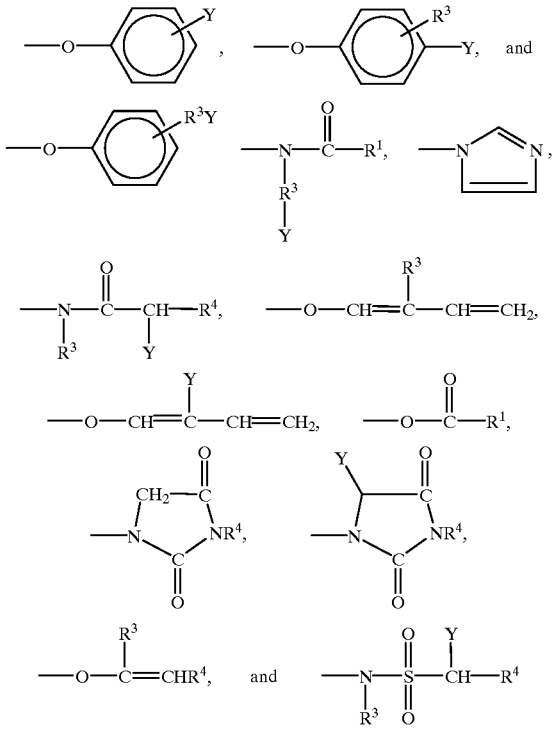

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^{-M+}$, $—N^+(R^3)_4X^-$ and $O<N(R^3)_3$ and most preferably —$SO_3^-M^+$ and —$CO_2^-M^+$ wherein $R^3$ is an alkyl chain containing from about 1 to about 4 carbon atoms, M is hydrogen or a cation which provides solubility to the bleach activator and X is an anion which provides solubility to the bleach activator. Preferably, M is an alkali metal, hydrogen, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of:

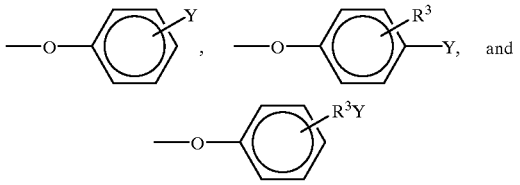

wherein $R^3$ is as defined above and Y is —$SO_3^-M^+$ or —$CO_2^+M^+$ wherein M is as defined above.

Another important class of bleach activators, including those of type b) and type c), provide organic peracids as described herein by ring-opening as a consequence of the nucleophilic attack on the carbonyl carbon of the cyclic ring by the perhydroxide anion. For instance, this ring-opening reaction in type c) activators involves attack at the caprolactam ring carbonyl by hydrogen peroxide or its anion. Since attack of an acyl caprolactam by hydrogen peroxide or its anion occurs preferably at the exocyclic carbonyl, obtaining a significant fraction of ring-opening may require a catalyst. Another example of ring-opening bleach activators can be found in type b) activators, such as those disclosed in U.S. Pat. No. 4,966,723, Hodge et al, issued Oct. 30, 1990.

Benzoxazin-type Bleach Activators—Such activator compounds disclosed by Hodge include the activators of the benzoxazin-type, having the formula:

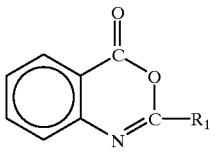

including the substituted benzoxazins of the type

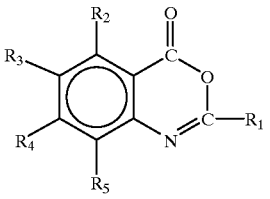

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

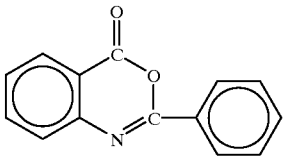

When the activators are used, optimum surface bleaching performance is obtained with washing solutions wherein the pH of such solution is between about 8.5 and 10.5 and preferably between 9.5 and 10.5 in order to facilitate the perhydrolysis reaction. Such pH can be obtained with substances commonly known as buffering agents, which are optional components of the bleaching systems herein.

N-Acyl Caorolactam Bleach Activators—The N-acyl caprolactam bleach activators of type c) employed in the present invention have the formula:

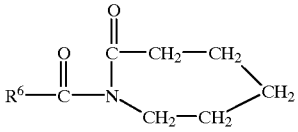

wherein $R^6$ is H or an alkyl, aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above. Caprolactam activators wherein $R^6$ comprises from 1 to about 6 carbon atoms provide hydrophilic bleaching species which are particularly efficient for bleaching beverage stains. Mixtures of hydrophobic and hydrophilic caprolactams, typically at weight ratios of 1:5 to 5:1, preferably 1:1, can be used herein for mixed stain removal benefits.

Highly preferred N-acyl caprolactams are selected from the group consisting of benzoyl caprolactam, octanoyl caprolactam, nonanoyl caprolactam, 3,5,5-trimethylhexanoyl caprolactam, decanoyl caprolactam, undecenoyl caprolactam, and mixtures thereof. Methods for making N-acyl caprolactams are well known in the art.

Contrary to the teachings of U.S. Pat. No. 4,545,784, the bleach activator is preferably not absorbed onto the peroxygen bleaching compound. To do so in the presence of other organic detersive ingredients could cause safety problems.

The bleach activators of type a), b) or c) will comprise at least about 0.1%, preferably from about 0.1% to about 50%, more preferably from about 1% to about 30%, most preferably from about 3% to about 25%, by weight of bleaching system or detergent composition.

The preferred amido-derived and caprolactam bleach activators herein can also be used in combination with rubber-safe, enzyme-safe, hydrophilic activators such as TAED, typically at weight ratios of amido-derived or caprolactam activators:TAED in the range of 1:5 to 5:1, preferably about 1:1.

The Peroxygen Bleaching Compound

The peroxygen bleaching systems useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxybydrate, urea peroxyhydrate, sodium percarbonate, and sodium peroxide. Particularly preferred are sodium perborate tetrahydrate, sodium perborate monohydrate and sodium percarbonate. Percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include mixtures of carbonate and sulphate, silicate, borosilicate, or fatty carboxylic acids.

The peroxygen bleaching compound will comprise at least about 0.1%, preferably from about 1% to about 75%, more preferably from about 3% to about 40%, most preferably from about 3% to about 25%, by weight of bleaching system or detergent composition. The weight ratio of bleach activator to peroxygen bleaching compound in the bleaching system typically ranges from about 2:1 to 1:5. Preferred ratios range from about 1:1 to about 1:3. The molar ratio of hydrogen peroxide yielded by the peroxygen bleaching compound to the bleach activator is greater than about 1.0, more preferably greater than about 1.5, and most preferably from about 2.0 to about 10. Preferably, the bleaching compositions herein comprise from about 0.5 to about 20, most preferably from about 1 to about 10, wt. % of the peroxygen bleaching compound.

The bleach activator/bleaching compound systems herein are useful per se as bleaches. However, such bleaching systems are especially useful in compositions which can comprise various detersive adjuncts such as surfactants, builders and the like.

Adjunct Detergent Ingredients

Preferably, adjunct detergent ingredients selected from the group consisting of enzymes, soil release agents, dispersing agents, optical brighteners, suds suppressors, fabric softeners, enzyme stabilizers, perfumes, dyes, fillers, dye transfer inhibitors and mixtures thereof are included in the composition of the invention. The following are representative examples of the detergent surfactants useful in the present detergent composition. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure a straight-chain alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred essential anionic surfactants for the detergent composition are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

In addition to a detersive surfactant, at least one suitable adjunct detergent ingredient such as a builder is preferably included in the detergent composition. For example, the builder can be selected from the group consisting of aluminosilicates, crystalline layered silicates, MAP zeolites, citrates, amorphous silicates, polycarboxylates, sodium carbonates and mixtures thereof. Other suitable auxiliary builders are described hereinafter.

Preferred builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Naz[(AIO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AIO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/grain. Additionally, the instant aluminosilicate ion exchange materials are still further characterized by their calcium ion exchange rate which is at least about 2 grains $Ca^{++}$/gallon/ minute/-gram/gallon, and more preferably in a range from about 2 grains $Ca^{++}$/gallon/minute/-gram/gallon to about 6 grains $Ca^{++}$/gallon/minute/-gram/gallon .

The non-particulate detergent product

The detergent tablets can be prepared simply by mixing the solid ingredients together and compressing the mixture in a conventional tablet press as used, for example, in the pharmaceutical industry.

The detergent tablets provided can be made in any size or shape. Prior to compaction, the detergent particles may be surface treated with a flow aid according to the present invention. The detergent tablets provided may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). As used herein, the term "non-particulate detergent product" includes physical shapes such as tablets, blocks, bars and the like.

Coating for non-particulate detergent product

In one embodiment, the tablets are coated with a coating in order to provide mechanical strength and shock and chip resistance to the compressed tablet core. The tablets are coated with a coating that is substantially insoluble in water so that the tablet does not absorb moisture, or absorbs moisture at only a very slow rate. The coating is strong so that moderate mechanical shocks to which the tablets are subjected during handling, packing and shipping result in no more than very low levels of breakage or attrition. Further, the coating is preferably brittle so that the tablet breaks up when subjected to stronger mechanical shock. Furthermore it is advantageous if the coating material is dissolved under alkaline conditions, or is readily emulsified by surfactants. This avoids the deposition of undissolved particles or lumps of coating material on the laundry load. This may be important when the coating material is completely insoluble (for example less than 1 g/l) in water.

As defined herein "substantially insoluble" means having a very low solubility in water. This should be understood to mean having a solubility in water at 25° C. of less than 20 g/L, preferably less than 5 g/l, and more preferably less than 1 g/l. Water solubility is measured following the test protocol of ASTM E1148-87 entitled, "Standard Test Method for Measurements of Aqueous Solubility".

Suitable coating materials are fatty acids, adipic acid and C8–C13 dicarboxylic acids, fatty alcohols, diols, esters and ethers. Preferred fatty acids are those having a carbon chain length of from C12 to C22 and most preferably from C18 to C22. Preferred dicarboxylic acids are adipic acid (C6), suberic acid (C8), azelaic acid (C9), sebacic acid (C10), undecanedioic acid (C11), dodecanedioic acid (C12) and tridecanedioic acid (C13). Preferred fatty alcohols are those having a carbon chain length of from C12 to C22 and most preferably from C14 to C18. Preferred diols are 1,2-octadecanediol and 1,2-hexadecanediol. Preferred esters are tristearin, tripalmitin, methylbehenate, ethylstearate. Preferred ethers are diethyleneglycol mono hexadecylether, diethyleneglycol mono octadecylether, diethyleneglycol mono tetradecylether, phenylether, ethyl naphtyl ether, 2 methoxynaphtalene, beta naphtyl methyl ether and glycerol monooctadecylether. Other preferred coating materials include dimethyl 2,2 propanol, 2 hexadecanol, 2 octadecanone, 2 hexadecanone, 2, 15 hexadecanedione and 2 hydroxybenzyl alcohol. The coating is a hydrophobic material having a melting point preferably of from 40° C. to 180° C.

In the preferred embodiment, the coating can be applied in a number of ways. Two preferred coating methods are a) coating with a molten material and b) coating with a solution of the material. In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 180° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid. For most purposes, the coating forms from 1% to 10%, preferably from 1.5% to 5%, of the tablet weight.

Addition of flow aids

In one embodiment, the process includes adding a flow aid to the particulate detergent composition in a range of from about 0. 1% to about 25% by weight of the particulate detergent composition before compaction.

As used herein, the term "flow aids" means any material capable of being deposited on to the surface of detergent particles so as to reduce the stickiness of the detergent particles and allow them to flow freely. Flow aids could include porous carrier particles selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof.

The preferred flow aids are zeolite A, zeolite X, zeolite Y, zeolite P, zeolite MAP and mixtures thereof. The term "zeolite" used herein refers to a crystalline aluminosilicate material. The structural formula of a zeolite is based on the crystal unit cell, the smallest unit of structure represented by $$Mm/n[(AlO_2)m(SiO_2)y].xH_2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

In the preferred embodiment of the present invention, the flow aid is added in an amount in a range, desirably, from about 0.1% to about 25% by weight of the particulate detergent, more desirably from about 1% to about 15% by weight, preferably from about 1% to about 10% by weight, and most preferably in an amount of about 5% by weight. It is undesirable to add more than 25% by weight of the flow aid because too excessive a force would be needed to make the detergent particles to stick together and stay in a particulate form. Flow aid addition in an amount less than about 0.1% by weight is also undesirable because little or no reduction in the stickiness of the detergent particles would occur, which upon compression into a particulate form would cause the resultant detergent tablet to not disintegrate readily when placed in water in a washing machine.

In one embodiment, the flow aids have a perfume adsorbed on their surface before being deposited on the detergent particles. Preferably, the flow aids are zeolites preferably containing less than about 20% desorbable water, more preferably less than about 8% desorbable water, and most preferably less than about 5% desorbable water. Such materials may be obtained by first activating/dehydrating by heating to about 150 to 350° C., optionally with reduced pressure (from about 0.001 to about 20 Torr). After activation, the perfume is slowly and thoroughly mixed with the activated zeolite and, optionally, heated to about 60° C. for up to about 2 hours to accelerate absorption equilibrium within the zeolite particles. The perfume/zeolite mixture is then cooled to room temperature and is in the form of a free-flowing powder. The term "perfume" is used to indicate any odoriferous material which is subsequently released into the aqueous bath and/or onto fabrics contacted therewith. The perfume will most often be liquid at ambient temperatures. A wide variety of chemicals are known for perfume uses, including materials such as aldehydes, ketones and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein. Perfumes also include pro-fragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g., pH drop) or may be enzymatically releasable pro-fragrances.

In the preferred embodiment, the amount of perfume adsorbed on the carrier material, such as zeolite for example, is preferably in the range of about 0.1% to about 50% by weight, more preferably in the range of about 0.5% to about 25% by weight, and most preferably in the range of about 1% to about 15% by weight of zeolite powder.

Compaction of particulate detergent to form non-particulate detergent product In the preferred embodiment, the process still further includes the step of compacting the particulate detergent composition having the bleach activators by applying a pressure in an amount sufficient to form the non-particulate detergent product having a density of at least about 1000 g/l. It is desirable to form a detergent tablet that has a density of at least about 1000 g/l so that the tablet will sink in water. If the density of the detergent tablet is less than about 1000 g/l, the tablet will float when placed in the water in a washing machine and this will detrimentally reduce the dissolution rate of the tablet in the water. It is desirable to apply at least that much pressure as is sufficient to compress the particulate detergent material to form a tablet having a density of at least about 1000 g/l. Too little a pressure will result in a compressed tablet with a density less than about 1000 g/l.

EXAMPLE A

Detergent tablets are formed from detergent particles having bleach activator particles (NOBS) having a particle size in the range of 200 microns to 2000 microns, according to the following composition:

TABLE A.1

| Particulate detergent Ingredients | % by weight |
|---|---|
| $C_{12-16}$ linear alkylbenzene sulfonate | 8.80 |
| $C_{14-15}$ alkyl sulfate/$C_{14-15}$ alkyl ethoxy sulfate | 8.31 |
| $C_{12-13}$ alkyl ethoxylate | 1.76 |
| polyacrylate (MW = 4500) | 2.40 |
| polyethylene glycol (MW = 4000) | 0.96 |
| sodium sulfate | 8.40 |
| aluminosilicate | 21.28 |
| sodium carbonate | 16.80 |
| protease enzyme | 0.32 |
| sodium perborate monohydrate | 2.08 |
| lipase enzyme | 0.17 |
| cellulase enzyme | 0.08 |
| NOBS extrudate | 4.80 |
| citric acid monohydrate | 2.25 |
| sodium bicarbonate | 2.75 |
| sodium acetate | 15.00 |
| free water | 1.60 |
| other minor ingredients (perfume etc.) | 2.24 |
| Total | 100.00 |

The detergent tablet formed is coated with a coating according to the following composition:

TABLE A.2

| Ingredient | % by weight |
|---|---|
| Detergent | 91.10 |
| Coating: | |
| dodecanedioc acid | 8.00 |
| carboxymethyl cellulose | 0.90 |
| Total | 100.00 |

Optionally, a flow aid (zeolite) is also added to the particulate detergent composition in about 5% by weight of the detergent and mixed by one of various methods, such as agitation for example.

The tablets are formed by compressing the tablet ingredients in a cylindrical die having a diameter of 55 mm using a laboratory press having a trade name Carver Model 3912, to form a tablet having a height of 20 mm. The formed tablets were then coated with the protective coating by dipping the tablet into a molten bath of the coating for about 3 seconds. The molten coating bath is maintained at a temperature of about 145 degrees centigrade.

The term "NOBS extrudate" as used herein, is an acronym for the chemical sodium nonanoyloxybenzene sulfonate, commercially available from Eastman Chemicals, Inc. The carboxymethyl cellulose used in the above example is commercially available from Metsa-Serla and sold under the trade name, Nymcel ZSB-16.

In another embodiment of the present invention, a method of laundering fabric materials in a washing machine includes the steps of providing a flexible porous bag adapted for receiving a non-particulate detergent product, providing a non-particulate detergent product having a bleach activator with particle size in a range of from about 100 microns to about 4000 microns, in a weight range of from about 0.1% to about 15% by weight, the non-particulate detergent having a density of at least 1000 g/l, according to the present invention as described herein, placing the non-particulate detergent product within the flexible porous bag, and placing the flexible porous bag containing the detergent product in the washing machine with the fabric materials to be washed.

The flexible porous bag is permeable to water and to the washing medium and is thus adapted for permitting entry of an aqueous washing medium through the bag, thereby dissolving the non-particulate detergent product placed therein, into the aqueous washing medium, and releasing a resultant wash solution from inside of the bag to outside of the bag and into the aqueous wash medium during a wash cycle.

The flexible porous bag is made of a material capable of retaining the non-particulate detergent product without allowing it to pass through until the detergent product has dissolved in the washing medium. The bag is also made of a material capable of withstanding the temperatures of washing laundry in a washing machine. The process of the invention may be applied not only to non-particulate detergents but also to any non-particulate product which is active during washing, such as, for example, bleaching agents, such as agents releasing chlorine or active oxygen (peroxygen compounds), bleaching catalysts, bleaching activators, bactericides, foam regulators, whiteners, agents preventing the re-deposition of soil, enzymes, softeners, agents capable of removing grease stains or other constituents having no direct effect on the soiling but capable of taking part in the laundry washing process.

The flexible bag may be made from any material which offers a sufficient resistance to water, such as a woven or non-woven material produced from natural or synthetic fibers. For example, the bag is formed of pure cotton either in the form of a fabric with a mesh opening of less than about 0.5 mm or in the form of a non-woven article with openings having a size in a range of from about 0.5 mm to about 0.8 mm.

Accordingly, having thus described the invention in detail, it will be obvious to those skilled in the art that various changes may be made without departing from the scope of the invention and the invention is not to be considered limited to what is described in the specification.

What is claimed is:

1. A laundry detergent tablet comprising:

a bleach activator having the general formula

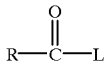

wherein R is an alkyl group containing from 5 to 18 carbon atoms wherein the longest linear alkyl chain extending from and including the carbonyl carbon contains from 6 to 10 carbon atoms and L is a leaving group, the conjugate acid of which has a $pK_\alpha$ in the range of from 6 to 13;

said bleach activator being in particulate form and having a particle size in a range of from 100 microns to 4000 microns;

said bleach activator being present in a range of from 0.1% to 15% by weight of said non-particulate detergent product; from about 0.1% to about 75% by weight of a peroxygen bleaching compound, wherein said bleach activator is dispersed within a matrix of said detergent tablet, said matrix having a density of at least 1000 g/l, further wherein said tablet is coated with a water-insoluble material selected from the group consisting of C12–C22 fatty acids, adipic acid, C8–C13 dicarboxylic acids and mixtures thereof.

2. The tablet of claim 1 wherein said particle size is in the range of from 200 microns to 3000 microns.

3. The tablet of claim 2 wherein said particle size is in the range of from about 200 microns to about 2000 microns.

4. The tablet of claim 1 wherein said particle size is in the range of from about 200 microns to about 1500 microns.

5. The tablet of claim 1 wherein said particle size is in the range of from about 300 microns to about 1000 microns.

6. The tablet of claim 1 wherein said bleach activator is present in a range of from about 1% to about 10% by weight of said tablet.

7. The tablet of claim 6 wherein said bleach activator is present in a range of from about 1% to about 8% by weight of said tablet.

8. The tablet of claim 1 wherein said peroxygen bleaching compound selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof.

9. The tablet of claim 1 wherein R is a linear alkyl chain containing from about 5 to about 12 and L is selected from the group consisting of:

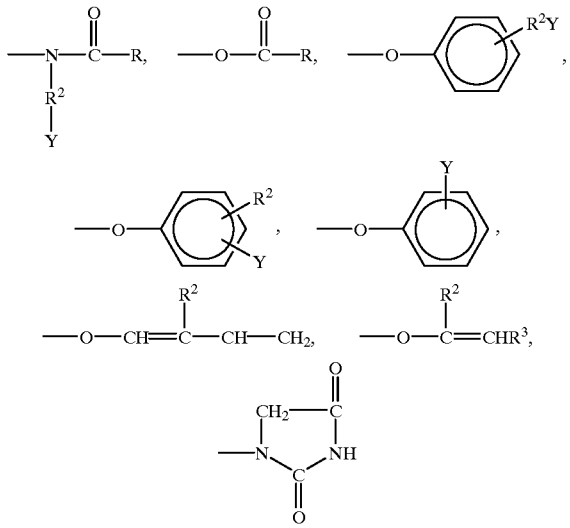

wherein $R^2$ is a linear alkyl chain containing from about 2 to about 6 carbon atoms, $R^3$ is an alkyl chain containing from about 1 to about 8 carbon atoms, and Y is $—SO_3^-M^+$ or $—CO_2^-M^+$ wherein M is an alkali metal, ammonium or substituted ammonium cation.

10. The tablet of claim 1 wherein R is a linear alkyl chain containing from about 5 to about 12 carbon atoms and L is selected from the group consisting of:

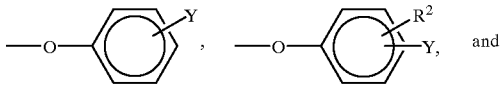

-continued

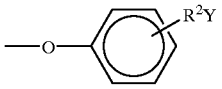

wherein $R^2$ is a linear alkyl chain containing from about 2 to about 6 carbon atoms, Y is —$SO_3$M+ or —COO—M+ wherein M is hydrogen, an alkali metal, ammonium or substituted ammonium cation.

11. The tablet of claim 1 wherein said bleach activator has the formula:

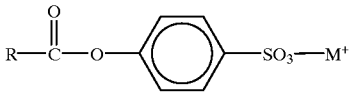

wherein R is a linear alkyl chain containing from about 5 to about 9 and M is sodium or potassium.

12. The tablet of claim 1 wherein said bleach activator is sodium nonanoyloxybenzene sulfonate.

13. The tablet of claim 1 wherein said bleach activator is sodium benzoyloxybenzenesulfonate.

14. The tablet of claim 1 wherein said bleach activator in particulate form is coated with from about 0.1% to about 10% by weight of a flow aid selected from the group consisting of finely divided aluminosilicates, silicas, crystalline layered silicates MAP zeolites, citrates, amorphous silicates, sodium carbonates and mixtures thereof.

15. The tablet of claim 14 further comprising adjunct detergent ingredients selected from the group consisting of enzymes, soil release agents, dispersing agents, optical brighteners, suds suppressors, fabric softeners, enzyme stabilizers, perfumes, dyes, fillers, dye transfer inhibitors, and mixtures thereof.

16. A method of laundering soiled clothes comprising the step of immersing said soiled clothes in an aqueous medium containing an effective amount of a tablet according to claim 1.

17. A method of laundering fabric materials in a washing machine, comprising the steps of:

providing a flexible porous bag adapted for receiving a detergent tablet;

providing a detergent tablet according to claim 1;

placing said detergent tablet within said flexible porous bag;

placing said flexible porous bag containing said tablet in said washing machine with said fabric materials to be washed; and said flexible porous bag being adapted for permitting entry of an aqueous washing medium through said bag, thereby dissolving said detergent tablet placed therein, into said aqueous washing medium, and releasing a resultant wash solution from inside of said bag to outside of said bag into said aqueous wash medium during a wash cycle.

* * * * *